United States Patent [19]

Welzel et al.

[11] Patent Number: 4,505,299

[45] Date of Patent: Mar. 19, 1985

[54] 3-PORT, 2-POSITION DIRECTIONAL CONTROL VALVE

[75] Inventors: Josef Welzel; Karl Krieger, both of Wuppertal, Fed. Rep. of Germany

[73] Assignee: Hermann Hemscheidt Maschinenfabrik GmbH & Co., Wuppertal, Fed. Rep. of Germany

[21] Appl. No.: 466,537

[22] Filed: Feb. 15, 1983

[30] Foreign Application Priority Data

Feb. 24, 1982 [DE] Fed. Rep. of Germany ..... 3206555

[51] Int. Cl.[3] ..... F15B 13/04

[52] U.S. Cl. ..... 137/596.1; 91/457; 137/871

[58] Field of Search ..... 91/457; 137/596, 596.1, 137/596.17, 862, 870, 871

[56] References Cited

U.S. PATENT DOCUMENTS

| | | | |
|---|---|---|---|
| 2,200,830 | 5/1940 | Beharrell et al. | 137/596.1 |
| 2,535,785 | 12/1950 | Couri | 137/596.17 |
| 3,081,793 | 3/1963 | Flatt et al. | 91/457 X |
| 3,814,133 | 6/1974 | Veh | 137/625.65 |
| 3,815,633 | 6/1974 | Greenwood et al. | 137/625.65 X |
| 3,821,880 | 7/1974 | Weirich et al. | 405/302 |
| 4,327,628 | 5/1982 | Weirich et al. | 405/302 X |

FOREIGN PATENT DOCUMENTS

| | | | |
|---|---|---|---|
| 2951232 | 7/1981 | Fed. Rep. of Germany | 137/596.17 |
| 759171 | 10/1956 | United Kingdom | 137/596.17 |

*Primary Examiner*—Gerald A. Michalsky

*Attorney, Agent, or Firm*—Berman, Aisenberg & Platt

[57] ABSTRACT

A 3-port, 2-position, directional control valve has two cylindrical closure elements for the alternate connection of a control line to a return flow line and a high pressure line. The switching force exerted on a thrust member is transmitted via pressure pins, and a manifold member with a centrally-positioned axial bore connected to the control line is arranged between the closure elements. Sealing elements on the closure elements seal the exit openings of the bore in the manifold member alternately. One of the pressure pins extends through the manifold member eccentrically while extending parallel to the axial bore and is always under pressure, like the high-pressure-side closure element, so that the closure element on the low pressure side is always held open in the zero position of the valve while the closure element on the high pressure side is acted on by the pressure medium in the direction of closure. The switching force required to open the valve is small because the pressurized cross-sections of the axial bore and the pressure pin are constructed to be small.

4 Claims, 1 Drawing Figure

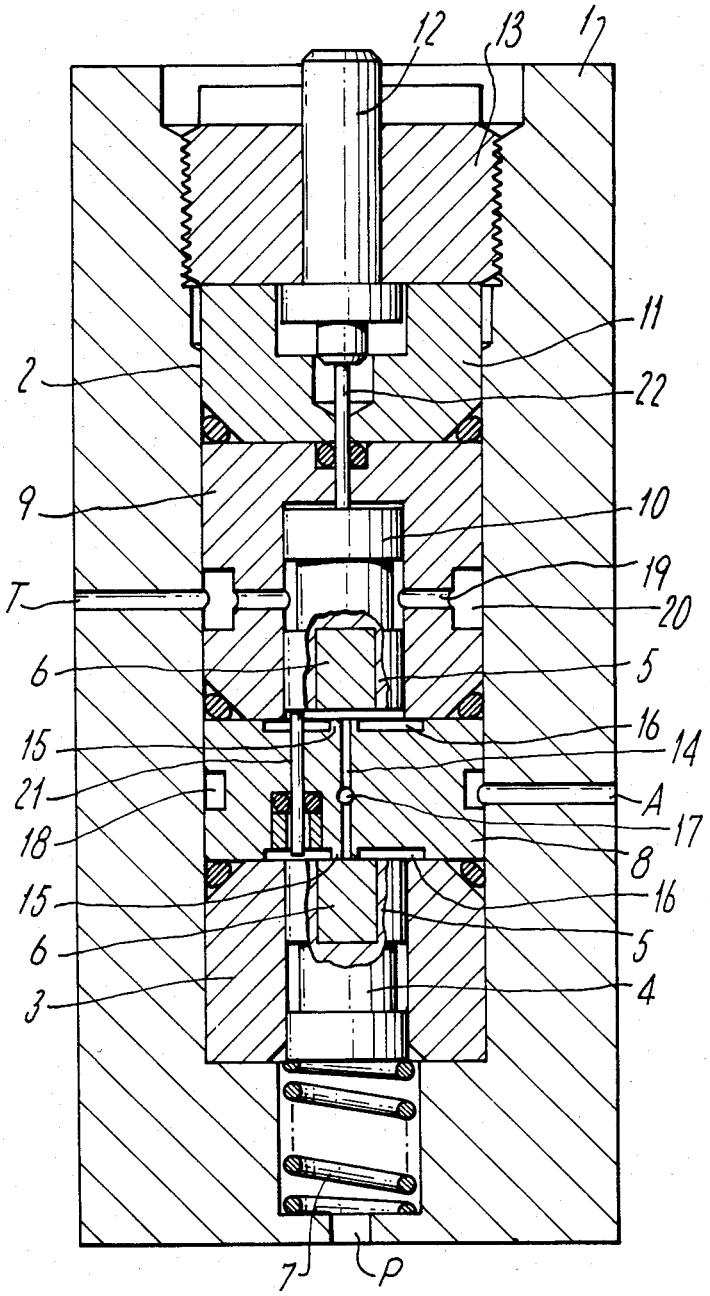
12
13
1
11
2
22
9
10
19
T
20
6
5
15
16
14
21
A
18
17
8
15
16
6
5
3
4
7
P

3-PORT, 2-POSITION DIRECTIONAL CONTROL VALVE

This invention relates to a 3-port, 2-position directional control valve for the alternate connection of a control line to a return flow line and a high pressure line, particularly in mining operations.

It is already known to provide 3-port, 2-position, directional control valves with two closure elements for the alternate connection of a control line to a return flow line and a high pressure line carrying a pressure medium such as hydraulic fluid. The closure element sealing the high pressure line is held in its closed position by a spring and by the pressure medium. To connect the control line to the high pressure line, a thrust member is pressed down to move the closure element on the low pressure side into a closed position in which the return flow line is separated from the control line. A pressure pin or rod arranged between the two closure elements transmits the switching force to the closure element on the high pressure side and pushes the latter into its opening position against fluid pressure and the spring force after the return flow line has been closed. As a result, the force to be exerted on the thrust member can become undesirably high, particularly as this force not only increases with the pressure of the pressure medium but depends in appreciable measure on the construction of the sealing surfaces.

The aim of the present invention is to construct a 3-port, 2-position, directional control valve in such a way that it can be switched using small switching forces even at high pressures.

With this aim in view, the invention is directed to a 3-port, 2-position, directional control valve comprising a first closure element and a second closure element both movable axially in the same sense in a central stepped bore of a valve housing for the alternate connection of a control line to a return flow line and a high pressure line carrying a pressure medium, a thrust member for exerting a switching force on said closure elements, a pressure pin extending between the closure elements to transmit said force, mutually-facing sealing elements provided in end faces of said closure elements, a centrally-arranged axial bore in said manifold member connected to the control line, and exit openings of said bore at end faces of said manifold member adapted to be sealed alternately by said sealing elements of the closure elements, said pressure pin extending through said manifold member eccentrically with respect to the axial bore therein and being adapted to be acted on by pressure medium on the high pressure side.

As a result of this construction, a valve according to the invention has only very small pressurised cross-sectional areas against which the closed valve needs to be opened. These areas are the cross-section of the axial bore provided centrally in the manifold plate and the cross-section of the pressure pin that is arranged eccentrically between the closure elements in the manifold plate. The 3-port, 2-position, directional control valve is held in the closed position automatically by the pressure medium present in the high pressure line. The closure element separating the control line from the high pressure line is subject to the pressure acting on the cross-sectional area of the axial bore. At the same time, the pressure pin or rod emerging from the manifold plate is acted on by the pressure medium passing between the closure element and a guide bush.

It thus follows that a force which holds the closure element on the low pressure side open with respect to the return flow line and against which the thrust member needs to be actuated during opening acts constantly on the pressure pin or rod. Consequently, the valve switches very reliably, because pressure medium can flow from the high pressure line to the control line only when the force of switching exerted at the thrust piece switch exceeds the force of closing. As soon as the force of switching diminishes, the valve again switches back into the closed position. A spring acting on the closure element on the high pressure side in the direction of closure thus requires only a small initial compression or tension.

The reliable switching of the directional control valve according to the invention permits the use of minimum cross-section both for the pressure pin or rod and for the axial bore. Because of the small cross-sections and the small initial compression or tension of the closure spring, the directional control valve can be switched with a relatively small switching force even when high pressures obtain in the fluid line containing the valve. The closure element associated with the pressure pin, which is constantly pressurised, switches back into the closed position reliably even when a 'backwash' has formed in the return flow line.

The constructional features of the valve also facilitate the manufacture of the individual valve components. These are simply-manufactured lathe-turned parts the dimensions of which need not be matched to one another accurately because no mutually co-axial cross-sections are required. The simple method of construction of the valve parts permits the overall dimensions of the directional control valve to be comparatively small, which is a distinct advantage when it is used in mining operations as a magnetically-actuated pre-control valve for the working valves of hydraulic, advancing, roof-supports.

An example of a 3-port, 2-position, directional control valve in accordance with the invention is shown in longitudinal section in the accompanying drawing, and this will now be described in detail.

A high pressure line P, a return flow line T and a control line A carrying an hydraulic pressure medium are connected to the valve housing 1 of the 3-port, 2-position, directional control valve. In its "closed" or "inactive" rest position as shown, the valve has the control line A connected to the return flow line T and blocked off from the high pressure line P. In the "active", working, position, the return flow line T is closed and P is connected to A. Pressure fluid then flows from the high pressure line P via the control line A to a working valve connected in series but not illustrated in the drawing.

The connection lines P, T and A of the valve terminate in a central stepped bore 2 of the valve housing 1 after having passed as bores through the wall of the housing. In the region of the deepest part of the borehole, where the high pressure line P terminates, a cylindrical guide bush 3 surrounds a cylindrical closure element 4 having a cylindrical recess 5 extending downwards from one end face of the closure element 4. Pressure medium is able to pass between the closure element 4 and the guide bush 3, i.e., in the small gap which exists between them. The recess contains, as a close fit, a sealing element 6. A helical compression spring 7 located in the extreme lower end-section of the bore 2 urges the closure element 4 against a manifold block or plate 8 abutting the guide bush 3 in the stepped bore 2. A further guide bush 9 with a closure element 10 within it abuts the manifold block or plate 8. The closure element 10 is constructed in the same way as the closure element 4 but is inserted in the reverse position so that the sealing elements 6 of both closure elements 4 and 10 are directed towards the manifold block or plate 8.

An insert or disc 11 abutting the guide bush 9 contains an axially-movable thrust member 12 by means of which the valve is actuated, for example, electromagnetically. The stepped bore 2 is sealed from the outside by a screw-threaded bush 13 which is screwed into the upper end of the housing 1. Seals (not numbered) are inserted between individual components of the valve to prevent leakage of fluid. An axial bore 14 extending along the longitudinal axis of the manifold block or plate 8 and of small flow cross-section terminates at the two end-faces of small-diameter collars 15 which are formed by producing annular grooves 16 concentrically to the axial bore 14 in the two end-faces of the block or plate 8. These grooves are so dimensioned that their diameter is less than the diameter of the sealing elements 6, while their outer diameter is greater than the outer diameter of the closure elements 4 and 10 respectively. From the axial bore 14 a radial bore 17 leads to an annular channel 18 extending round the outer cylindrical surface of the manifold block or plate 8 and connected to the control line A. A pressure pin or rod 21 is arranged eccentrically of the axial bore 14 in the manifold block or plate 8 between the closure elements 4 and 10, the rod or pin being axially movable in a bore extending parallel to the axial bore 14 in the block or plate 8. The pressure pin or rod 21 is constructed to be somewhat longer than the thickness of the manifold block or plate 8 so that its ends extend into the annular grooves 16 at the two end-faces of the manifold block or plate. A further pressure pin or rod 22 is arranged between the thrust member 12 and the closure element 10. To connect the axial bore 14 to the return flow line T when the closure element 10 is open, a radial bore 19 and an annular duct 20 are provided in the guide bush 9. The above-described 3-port, 2-position, directional control valve is illustrated in the zero position in which the control line A is open to the return flow line T and is blocked to the high pressure line P. The sealing element 6 of the closure element 4 acted on by high pressure covers the exit opening in the lower collar 15 of the axial bore 14, the metallic annular upper end surface of the closure element 4 surrounding the recess 5 being positioned below the respective annular groove 16 without making contact with the block or plate 8. Pressure medium entering the annular groove 16 through the small gap between the guide bush 3 and the closure element 4 acts on the lower end of the eccentrically-mounted pressure pin or rod 21 so as to urge the latter against the metallic annular lower end surface of the closure element 10, thereby keeping this element open. The control line A is then connected to the return flow line T via the radial bore 17 terminating in the annular channel 18 and the axial bore 14 of the manifold block or plate 8 and, further, via the opened closure element 10 and the radial bore 19.

The control line A is connected to the high pressure line P by actuating the thrust member 12. Via the pin or rod 22, the actuating force is transmitted to the closure element 10 from the thrust member 12. The sealing element 6 of the closure element 10 covers the exit opening in the upper collar 15 of the axial bore 14 and closes the feed to the return flow line T. The switching movement is transmitted from the pin or rod 21 resting against the annular lower end surface of the closure element 10 to the closure element 4 which now opens against the pressure acting on the lower end of the pin or rod 21 and/or the axial bore 14, and against the force of the closing spring 7. However, the force which needs to be used is comparatively small because the cross-sections to be opened are very small and the force of the closure 7 is also small. Following the opening of the closure element 4 on the high pressure side, the pressure fluid flows from the high pressure line P via the axial bore 14 and the radial bore 17 to the annular channel 18 into the control line A.

We claim:

1. A 3-port, 2-position, directional control valve comprising a first closure element and a second closure element both movable axially in a central stepped bore of a valve housing for the connection, via fluid flow-paths extending partially along outside surfaces of said closure elements, of a control line to a return flow line and to a high pressure line carrying a pressure medium, a thrust member for exerting a switching force on said first closure element, a pressure pin extending between said first closure element and said second closure element to transmit said force to said second closure element, mutually-facing sealing elements provided in end faces of said closure elements, a manifold member inserted between said closure elements, a centrally-arranged axial bore in said manifold member connected to the control line, and exit openings of said bore at end faces of said manifold member adapted to be sealed alternately by said sealing elements of said closure elements, said pressure pin being arranged to extend through said manifold member in a non-central bore therein which is substantially parallel to, and eccentrically-offset from, the axial bore in said manifold member and being adapted to be acted on by high pressure medium, said pressure pin being axially-movable in said non-central bore without lateral displacement.

2. A 3-port, 2-position, directional control valve according to claim 1, wherein the exit openings of the centrally-arranged axial bore are constructed in the form of collars, such collars being obtained by providing annular grooves concentrically of the axial bore in end faces of the manifold member, and wherein the sealing elements are adapted to completely cover the exit openings of the axial bore and are inserted in cylindrical recesses in end faces of the closure elements facing the manifold member, the pressure pin being arranged to abut against annular surfaces on those end faces.

3. A 3-port, 2-position, directional control valve according to claim 1, wherein the closure elements are located in guide bushes having side-walls resting against the internal walls of the stepped bore.

4. A 3-port, 2-position, directional control valve according to claim 1, wherein the axial bore of the manifold member communicates with an annular channel extending around the outer wall of the manifold member connected to the control line via a radial bore in the manifold member.

* * * * *